United States Patent [19]

Nyssen

[11] 4,070,886

[45] Jan. 31, 1978

[54] SPIRAL PIPE FORMING MACHINE WITH DEVICE FOR ALIGNING SPIRALLING ROLLS

[76] Inventor: Adrianus Marinus Nyssen, 114 Windsor St., Chilliwack, British Columbia, Canada

[21] Appl. No.: 756,766

[22] Filed: Jan. 5, 1977

[51] Int. Cl.[2] ..... B21C 37/12

[52] U.S. Cl. ..... 72/49

[58] Field of Search ..... 72/49, 50, 133, 135, 72/145, 180, 181

[56] References Cited

U.S. PATENT DOCUMENTS

| | | | |
|---|---|---|---|
| 1,659,752 | 2/1928 | Thorsby | 72/49 |
| 3,269,162 | 8/1966 | Fay | 72/49 |
| 3,417,587 | 12/1968 | Campbell | 72/50 |
| 3,606,783 | 9/1971 | Lewis | 72/49 |
| 3,991,597 | 11/1976 | Krakow | 72/49 |

FOREIGN PATENT DOCUMENTS

| | | | |
|---|---|---|---|
| 2,520,544 | 11/1975 | Germany | 72/50 |
| 1,080,770 | 8/1967 | United Kingdom | 72/49 |

*Primary Examiner*—E. M. Combs
*Attorney, Agent, or Firm*—Lee & Smith

[57] ABSTRACT

An improved apparatus for continuously forming spirally corrugated metal pipe from an elongated sheet of metal which is first impressed with longitudinal corrugations in a corrugating device and the spiralled into a pipe in a three roll forming device, each roll of which is composed of a plurality of individual rollers. Each individual roller is mounted for rotation about its axis in an individual roller yoke, with each of the roller yokes of each roll being in constant abutment, but with adjacent roller yokes being uninterconnected. Individual roller yokes of each roll are positioned along a guide, with each yoke being both freely displaceable along the guide along a horizontal path generally parallel to the axis of the formed pipe, and also pivotable about a vertical center axis. One of the rolls, termed herein a horn roll, is situated to contact the inner wall of the pipe as it is formed, while the other two rolls, respectively termed the lead and buttress rolls, are situated to contact the outer wall of the pipe. A rigid frame member is attached to the corrugating device, extending from the corrugating device into the three roll forming device in contact with either end of each of the lead and buttress rolls. The buttress roll is the farthest downstream of the three rolls and is adjustable on an angle to the vertical in order to vary the diameter of successive helical convolutions of the metal sheet, therefore varying the diameter of the pipe produced. A downwardly depending adjustment arm is attached to an end roller yoke of the horn roll and slideably engages the rigid frame member. When the corrugating device is pivoted relative to the three roll forming device, the rigid frame member automatically relocates the positions of each of the three rolls and adjusts spacings between center axes of adjacent rollers of each roll to assure that the individual rollers constantly and correctly align with the corrugations of the metal sheet as it enters the forming device and is spiralled into helical convolutions.

17 Claims, 6 Drawing Figures

SPIRAL PIPE FORMING MACHINE WITH DEVICE FOR ALIGNING SPIRALLING ROLLS

SUMMARY OF THE INVENTION

The Background

This invention relates to machines for continuously manufacturing spirally corrugated metal pipe, and more particularly to a machine for manufacturing spirally corrugated metal pipe from an elongated sheet of metal having a novel apparatus for adjusting each of the three forming rolls of the multiple roll pipe forming device.

Machines for manufacturing spiral pipe are well known, as exemplified by U.S. Pat. No. 1,659,792, directed to an apparatus for manufacturing spiral pipe having a smooth wall, and U.S. Pat. No. 3,247,692, directed to an apparatus for manufacturing spiral pipe having helical corrugations impressed in the wall thereof. In such machines, an elongated sheet of metal is spiralled into helical convolutions in a three roll forming device. Each of the rolls of the three roll forming device is composed of a plurality of individual rollers and has a composite roll axis generally parallel to the axis of the formed pipe.

In any spiral pipe forming machine in which each of the forming rolls is comprised of a plurality of individual rollers, it is imperative that the rotational axis of each of the individual rollers be maintained perpendicular to the longitudinal axis of the metal sheet at all times. Therefore, in the afoementioned U.S. Pat. No. 1,659,792, the individual rollers of each roll are pivotally mounted so that this relationship continually persists. Likewise, the individual rollers of the aforementioned U.S. Pat. No. 3,247,692 are mounted in individual, pivotal yokes.

Spiral pipe forming machines of the three roll type are used to manufacture helical pipe in varying diameters. To do so, the frame upon which the elongated sheet of metal is retained prior to spiralling of the sheet into helical convolutions is pivoted relative to the three roll forming device to alter the spacing between adjacent convolutions. One or more of the three rolls in the forming device is also adjusted to change the diameter of the helical convolutions so that as the elongated sheet is spiralled into helical convolutions, adjacent edges of the spiralled sheet abut sufficiently for forming of a water-tight seam, whether it be by welding or by forming a lock seam.

In a spiral pipe forming machine which forms corrugated sheet metal in to a spiral pipe, it is important that the individual rollers of each of the three rolls align with the valleys of the corrugations or the undersides of the ridges of the corrugations, depending on whether the roll is located within or without the helical convolutions as they are formed in the metal sheet. If not, during formation of the spiral pipe, corrugations may be marred and adjacent edges of helical convolutions may not abut correctly for proper seam formation. Therefore, as illustrated in U.S. Pat. No. 3,247,692, adjacent yokes of each roller of each roll of the three roll forming device are mounted in ways and interlocked with "keys" so that proper spacing is maintained between adjacent yokes, yet each roller of each roll may be shifted and aligned relative to the corrugations of the elongated sheet so that the rolls constantly align with valleys or undersides of ridges of the corrugated metal sheet.

A substantial disadvantage with apparatus of this nature is that each time a different diameter of spirally corrugated pipe is desired, after the corrugating deivce has been pivoted, the lead, horn and buttress rolls must be manually shifted in their respective guides and each of the individual rollers of each of the three rolls manually pivoted so that there is proper alignment in the valleys or undersides of ridges of the corrugations. Unless a different wall thickness of metal is to be employed, the corrugated metal sheet remains sandwiched between the three rolls during shifting and pivoting, and therefore opposes movement of the three rolls, necessitating that large forces be applied by the machine operator to properly realign the three rolls.

Another disadvantage with apparatus of this nature is that as the machine is operated, grit and metal filings tend to collect in each of the keys and their keyways in each of the adjacent roller yokes, inhibiting each adjustment of the individual rollers when the diameter of pipe being manufactured is changed. Often, foreign matter which collects in the keys and keyways tends to lock adjacent roller yokes together, necessitating extreme force to be applied to each roll in order to change the pivotal positions of each of the individual rollers or disassembly of the three roll forming device to clean the foreign matter from the keys and keyways.

The prior art has recognized the desirability of eliminating the keys discussed above or any other means of interlocking adjacent roller yokes. For example, U.S. Pat. No. 3,606,783 discloses a three roll forming apparatus using segmented rolls for forming spiral pipe which eliminates the need for keys or keyways. Each individual roller of each roll is mounted in a yoke, but the keys of the abovediscussed U.S. Pat. No. 3,247,692 are unnecessary. However, to maintain the horizontal positions of each of the three forming rolls and assure that the rollers of each roll properly align with valleys or undersides of ridges of the corrugated sheet, a spacer block or wedge must be clamped against either end of each roll. For each different diameter of pipe to be produced, different wedges must be substituted in the apparatus. Not only is this means of maintaining the rolls in alignment clumsy, preciseness of alignment is sacrificed by the necessity of fixed-angle wedges, so that slight variations in thickness of the metal sheet or variations in the width of the sheet cannot be readily accommodated by a slight pivoting of each individual roller yoke. In addition, versatility of the apparatus is limited by the number of different wedges available; an infinite variety of pipe diameters is unattainable.

A disadvantage of all prior art spiral pipe forming machines is the requirement of trial-and-error testing each time the angular position between the corrugating device and the pipe forming device is changed to vary the diameter of pipe manufactured. The three composite rolls must be properly shifted manually to align with corrugation ridges and valleys without marring the corrugations and at the same time without transversely shifting the sheet. Even when the rolls are properly shifted, prior art apparatus often will not hold the diameter of the manufactured pipe constant, allowing it to grow with each revolution and consequently requiring an adjunct apparatus to maintain a constant pipe diameter. Such an apparatus is disclosed in U.S. Pat. No. 3,256,724.

THE INVENTION

The present invention overcomes the foregoing disabilities of the prior art and others by providing an improved apparatus for continuously forming spirally corrugated metal pipe from an elongated sheet of metal which has no interlock between individual rollers of each roll of the three roll forming device. As in the prior art, the apparatus has a corrugating device to impress longitudinal corrugations in the metal sheet, a three roll forming device for accepting the corrugated sheet and spiralling it into successive, adjacent helical convolutions, and a seaming device to join adjacent helical convolutions.

The individual rollers of each roll of the three roll forming device are unconnected. Those two rolls which are maintained in contact with the exterior of the helical convolutions, termed respectively the lead and buttress rolls, are automatically shiftable on lines parallel to the central axis of the formed pipe by an adjustment frame means attached to, and pivotal with, the corrugating device. The third roll, designated herein the horn roll, which is located within the helical convolutions, is also attached to the frame means by a vertical adjustment arm which is affixed to an outboard roller yoke of the third roll and which slideably engages the frame means.

The horn roll is mounted on a horizontally adjustable horn member. The horn member also carries an upper seaming roll of a pair of conforming seaming rolls for forming a lock seam in adjacent helical convolutions of the formed pipe. As the angle between the corrugating device and the three roll forming device is varied when a larger or smaller pipe diameter is desired, the horn member is adjusted horizontally to assure that the upper lock seaming roll is always in proper registration with the adjoining adjacent edges of the helical convolutions. At the same time, the lower seaming roll is adjusted on a slide so that it always resides beneath the upper roll, with lock seam elements of adjoining edges of the convolutions sandwiched between the two rolls.

The horn roll forms a pivot axis at which the corrugated sheet is spiralled into helical convolutions. To assure that the individual rollers of the horn roll are always located in proper alignment to the corrugations in the metal sheet, a pair of elongated, extensible contraction mechanisms straddle the rollers of the horn roll. Each of the mechanisms is connected to the outboard roller yoke to which the vertically extending adjustment arm is attached, and is also attached to the opposite outboard roller yoke. As the first outboard roller yoke is either pivoted or displaced, the remaining roller yokes slavishly follow.

The buttress roll, which is the farthest downstream of the two rolls which contact the outer periphery of the elongated sheet, is adjustable on an angle to the vertical to permit varying diameters of spiral pipe to be formed by the spiral pipe forming machine. A slight displacement of the buttress roll will allow for greatly varying diameters of pipe to be manufactured, so that a small range of displacement for the buttress roll will provide for manufacture of pipe from the minimum diameter accommodated by the apparatus up to a maximum feasible diameter of pipe manufactured.

The first of the two outer rolls, the lead roll, is vertically adjustable in order to accommodate varying gauge thicknesses of the metal sheet, and also to prestress the sheet as it enters the three roll forming apparatus, if desired, to assure regular and consistant diameters of pipe formed by the apparatus.

By reason of the various features of the invention as described in detail hereinafter, spiral pipe forming machines according to the invention are extremely efficient and reliable under all operative conditions.

BRIEF DESCRIPTION OF THE DRAWINGS

The invention is illustrated in the following drawings in which.

DETAILED DESCRIPTION OF THE INVENTION

Figures 1, 2:
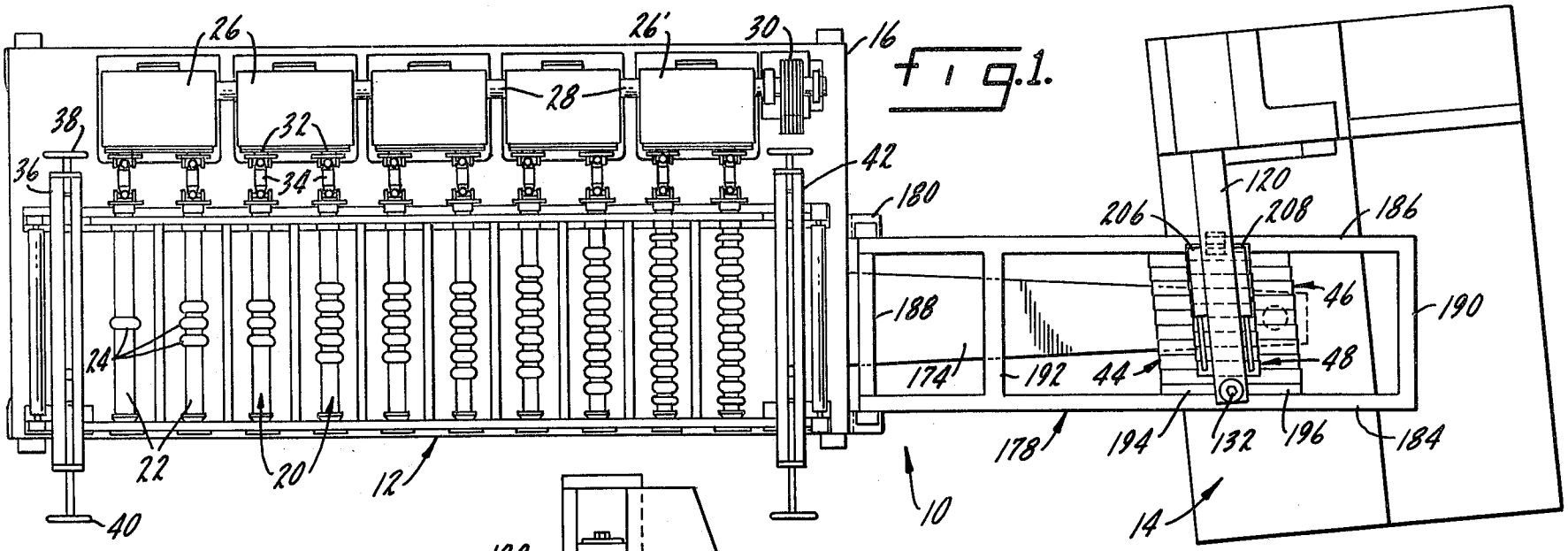
FIG. 1 is a top plan schematic illustration of an apparatus according to the invention.
FIG. 2 is a side elevational view of a portion of the apparatus of FIG. 1.

One embodiment of a spiral pipe forming apparatus according to the invention is generally designated by the reference numeral 10 in FIG. 1. The apparatus illustrated is composed of a corrugating or roll forming device 12 and a multiple roll pipe forming device 14. Apparatus not illustrated, but utilized in combination with the illustrated apparatus, as one skilled in the art will appreciate, is a decoiling apparatus for uncoiling the elongated metal sheet from a roll prior to its entry into the corrugating device 12, and a flying cut-off device, such as that described in applicant's U.S. Pat. No. 3,815,455, for sequentially severing predetermined lengths of pipe emerging from the multiple roll pipe forming device 14 as the apparatus 10 is continuously operated.

The corrugating device 12 consists of a carriage 16 mounted for pivoting relative to the multiple roll pipe forming device 14 on a plurality of wheels 18 (one illustrated). Although, alternatively, the forming device 14 can be mounted on wheels for pivoting relative to the corrugating device, due to stressive forces involved, it is preferred that the corrugating device be movable and the forming device be stationary.

The corrugating device 12 carries a plurality of corrugating rolls 20 for successively forming longitudinal corrugations in a sheet of metal as it passes through the corrugating device (from left to right in FIG. 1). As is well known in the art, each of the corrugating rolls 20 comprises a complementary pair of rolls designated a stand, composed of an upper roll having a shaft 22 with one or more impressing rollers 24 mounted thereon, and a lower roll (not illustrated) which complements the structure of the upper roll to form longitudinal corrugations in the elongated sheet of metal.

Each of the shafts 22 of the corrugating rolls 20 is provided motive power by a gear drive box 26. Each gear box 26 drives a pair of roll stands, so that a corrugating device employing 10 roll stands will employ five gear boxes.

Each of the gear boxes 26 has an input shaft 28 which, as illustrated, is connected for direct drive by a preceeding gear box, excepting the right-most gear box 26' which is driven by a motive source (not illustrated) through a drive pulley 30. The motive source, normally an electric motor, is mounted in the interior of the carriage 16.

Each of the gear drive boxes 26 has a pair of output shafts 32. Each output shaft 32 is connected through a universal joint 34 to a corrugating roll 20 with which it is aligned. The universal joints permit varying thickness metal sheets to be corrugated without the need to relocate the output shaft 32.

As the elongated sheet of metal enters the corrugating device 12, it is properly aligned with the corrugating rolls 20 by an edge guide member 36. The edge guide member 36 has a pair of horizontally disposed guide wheels (not illustrated) adjoining opposite marginal edges of the metal sheet as it enters the corrugating device. Screw adjustment members 38 and 40 provide for precise alignment of the edge guide rollers. Similarly, a second edge guide member 42 is located at the output end of the corrugating device 12 to assure proper alignment of the now corrugated sheet of metal as it enters the multiple roll pipe forming device 14.

The embodiment of the apparatus 10 illustrated is equipped with seaming rolls to complete a lock seam to securely fasten adjacent helical convolutions of pipe together. Although not illustrated, the carriage 16 also carries means to partially form lock seam elements in opposed marginal edges of the metal sheet just prior to entering the pipe forming device 14. Such lock seam elements, commonly termed "stove pipe" seam elements, and the formation thereof are old in the art, as exemplified by British Patent Specification No. 4513 (1894).

The multiple roll pipe forming device 14 curls a sheet of corrugated metal emanating from the roll forming device 12 into a series of adjacent, helical convolutions. As illustrated in greater detail in FIGS. 2–6, the multiple roll pipe forming device 14 employs three forming rolls, a lead roll assembly 44, a buttress roll assembly 46 and a horn roll assembly 48.

Each of the roll assemblies 44, 46 and 48 is composed of a plurality of individual rollers 50. The number of individual rollers 50 comprising each of the roll assemblies 44 through 48 will depend on the number of corrugations impressed in the elongated sheet of metal. Nine individual rollers of each of the roll assemblies 44 through 48 are depicted in the drawings, corresponding to those necessary for forming helical convolutions in a $27\frac{1}{2}$ inch wide flat sheet of metal which is impressed with corrugations $\frac{1}{2}$ inch deep and $2\frac{2}{3}$ inches apart.

Figure 3:
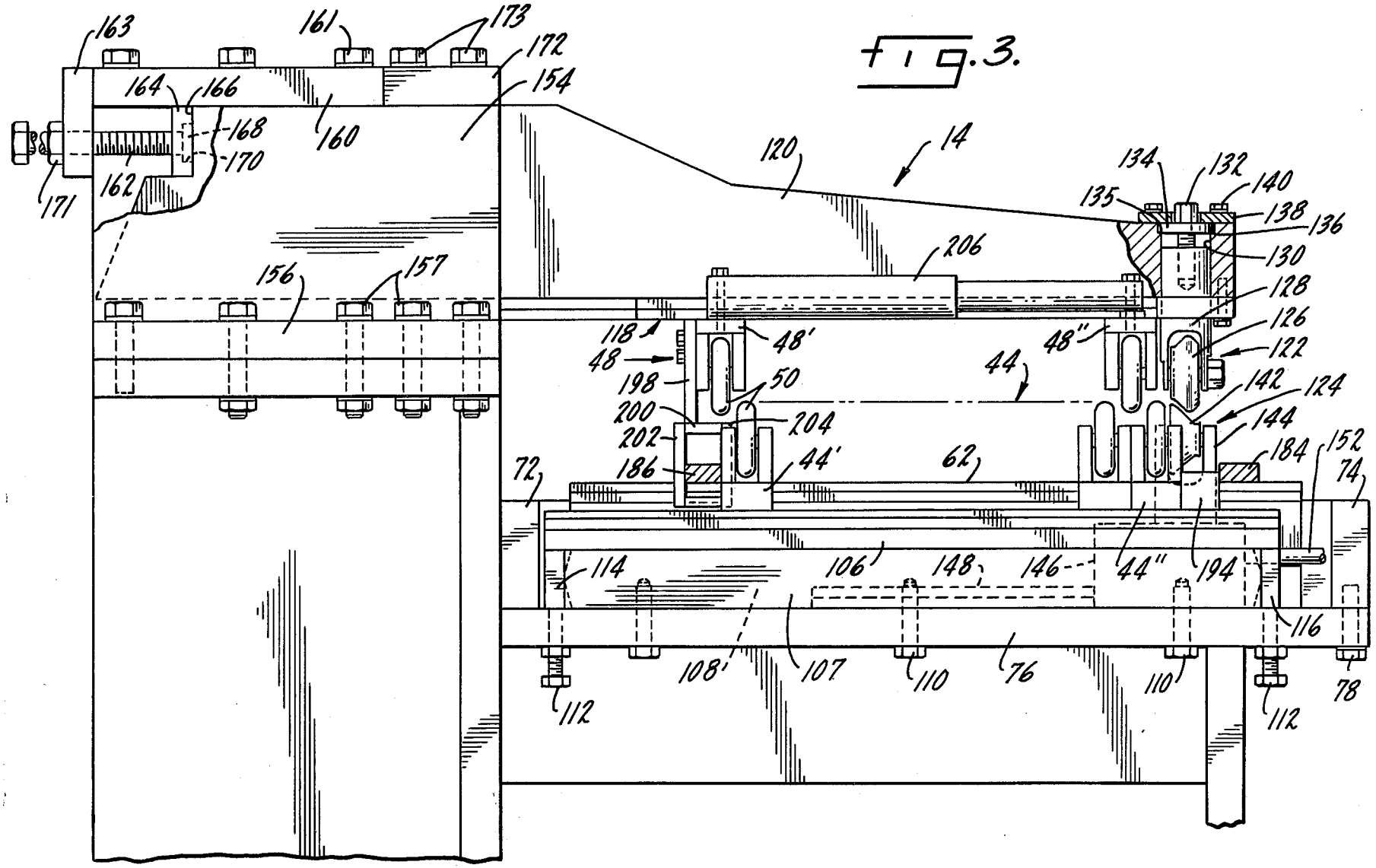
FIG. 3 is an enlarged schematic illustration of the spiralling apparatus of the invention, with portions removed for clarity of illustration.
Figure 5:
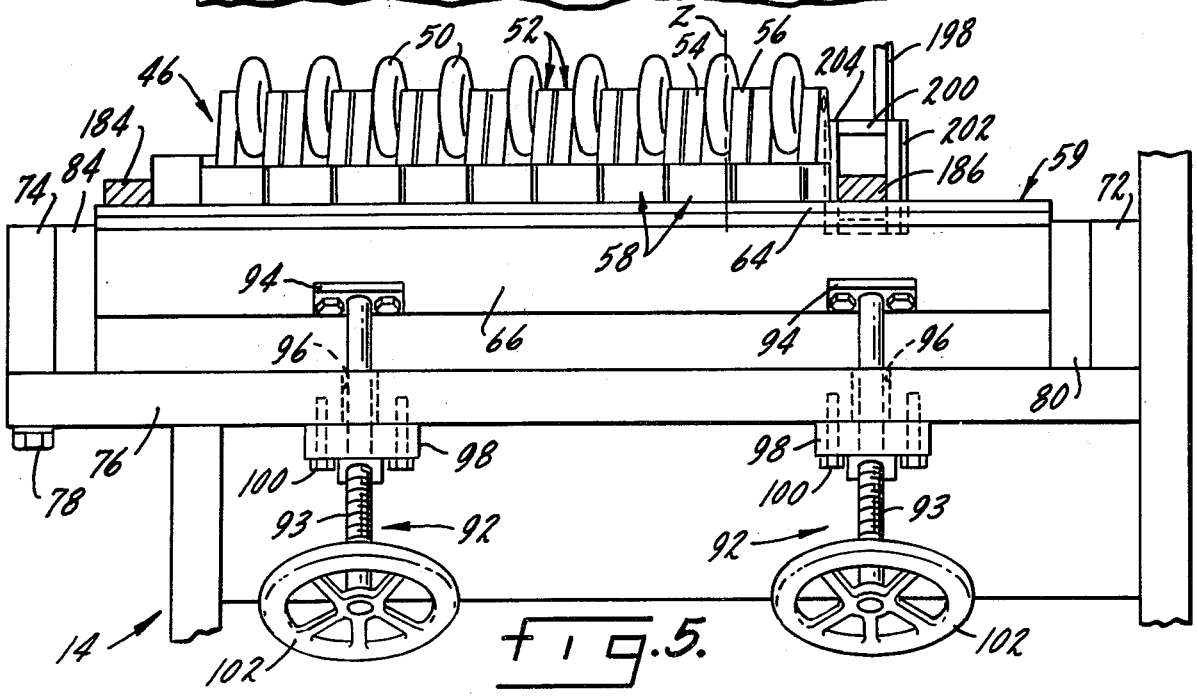
FIG. 5 is rear perspective illustration of the buttress roll assembly of the three roll forming device and the means for adjusting the buttress roll to provide for varying diameters of helical convolutions of spiral pipe formed by the apparatus.

As best illustrated in FIGS. 3 and 5, each of the individual rollers 50 is mounted for rotation about its central axis 51 within a roller yoke 52. Although the yokes of the roll assemblies 44 through 48 vary somewhat in outward appearance, they are functionally identical. Roller yokes 52 for the individual rollers 50 of the buttress roll assembly 46 only will therefore be described in detail, it being understood that roller yokes for the roll assemblies 44 and 48 vary in superficial detail only.

Each roller yoke 52 is composed of a pair of upstanding plate elements 54 and 56 which sandwich an individual roller 50 between them. An individual central axis shaft 51 is journalled in a bearing in each individual roller 50 and is immovably secured within apertures in the plate elements 54 and 56.

The plate elements 54 and 56 are securely fastened to a horizontal yoke plate 58. As illustrated, although the plate elements 54 and 56 and yoke plates 58 of each of the yokes 52 are in direct abutment, there is no interconnection between adjacent roller yokes. Rather, the individual roller yokes 52 adjoin one another at smooth interfaces generally parallel to planes encompassing the peripheries of the individual rollers 50, thus allowing relatively uninhibited sliding movement between adjacent roller yokes.

Each roller yoke 52 is pivotally and slideably positioned within a guide 59 located in the multiple roll pipe forming device 14. For horizontal displacement of each yoke in the guide and pivoting about an axis Z, each horizontal yoke plate 58 includes a cylindrical centered plug 60 attached to the horizontal yoke plate directly beneath the shaft 51. The plugs 60 extend between a pair of elongated parallel plate portions 62 and 64 of the guide 59 which are firmly attached to opposed edge portions of an adjustable buttress bearing block 66. Each cylindrical plug 60 has an enlarged annular flange member 68 which underlies overhanging portions of the elongated plates 62 and 64. Therefore, the individual roller yokes 52 are irremovably mounted within a channel 70 formed by the parallel plates 62 and 64, but are allowed to pivot and move transversely along the channel 70.

Figure 6:
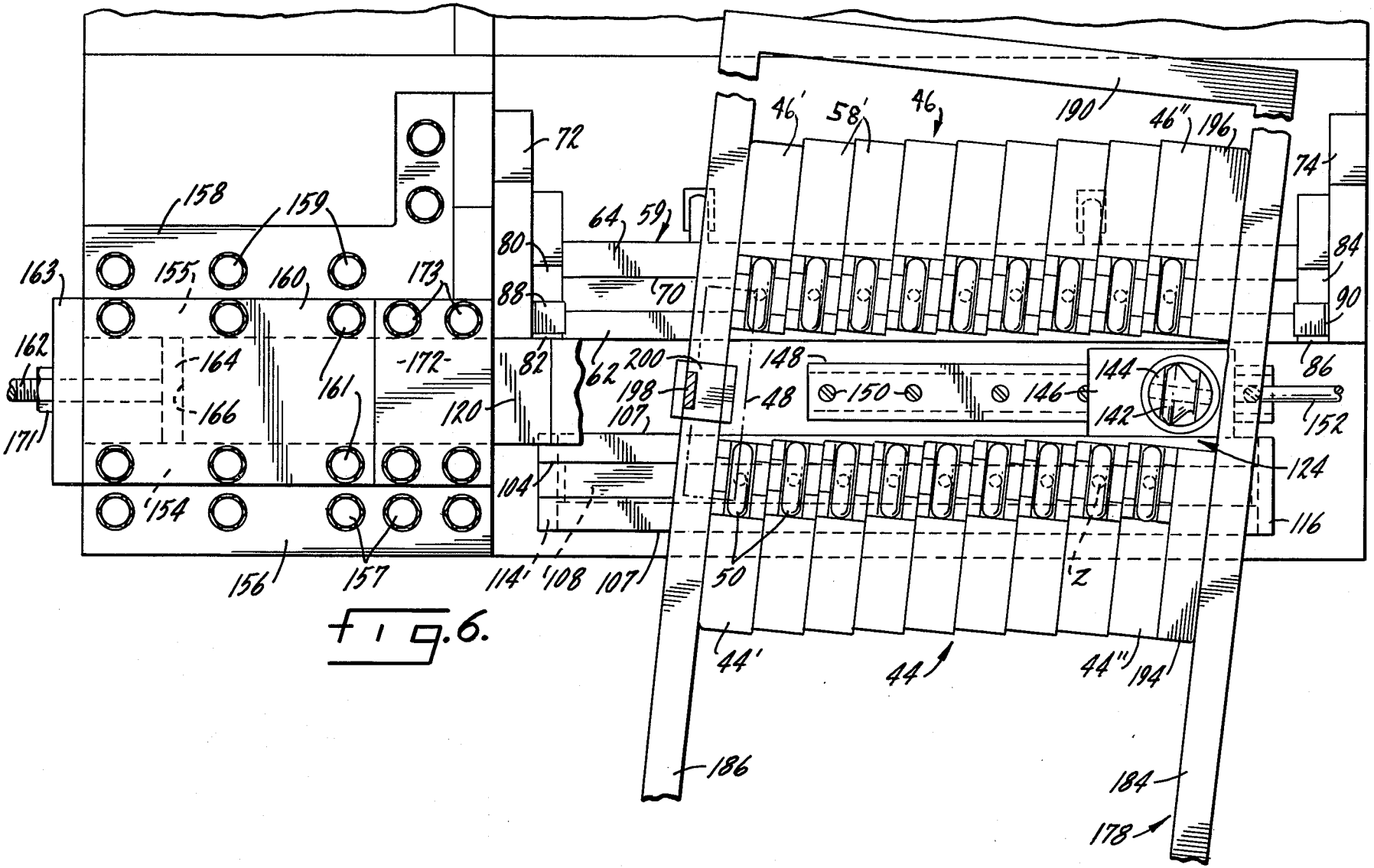
FIG. 6 is a top schematic illustration of the three roll forming device, with a portion of the horn member removed for clarity.

The yoke plates 58 each have an integral horizontal parallel plate extension 58' as illustrated (FIG. 6). The extensions increase the interfacing surface between adjacent yokes 52 to lessen wear of the yokes as their relative positions are changed and to increase stability of the buttress roll assembly. Each of the horn and lead roll assemblies is also similarly extended.

As illustrated, the entire buttress roll assembly is adjustable on an angle to the vertical, increasing the versatility of the pipe forming device 14 by allowing varying diameter pipe to be manufactured by the same apparatus. The adjustable buttress bearing block is located between a pair of upstanding guide support elements 72 and 74 which are immovably affixed to a horizontal table portion 76 of the multiple roll pipe forming device 14. As illustrated, the support element 74 is affixed to the table 76 by a plurality of bolts 78 threadedly secured in conforming apertures in the support element 74. The element 72 is similarly immobily attached to the pipe forming device 14.

A pair of angularly disposed parallel guide bars 80 and 82 are attached to the upstanding guide support element 72. A like pair of parallel guide bars 84 and 86 are attached to the upstanding guide support element 74. Sandwiched between the guide bars 80 and 82 is a slender slide member 88 which is firmly attached to the adjustable buttress bearing block 66. Similarly, a slide member 90 attached to the opposite end of the buttress bearing block 66 is sandwiched between the guide bars 84 and 86. A close tolerance is maintained between each slide member and its respective pair of guide bars to assure that the buttress roll assembly is solidly maintained in place. Therefore, the buttress bearing block is adjustable at a precise angle to the vertical depending on the angular disposition of the guide bars 80 through 86 and the slide members 88 and 90.

To retain the buttress bearing block 66 at a proper, preselected location, and provide for convenient adjustment of the buttress roll assembly to allow variation in the diameter of pipe being manufactured by the forming apparatus 10, two or more control rods 92 are employed. Each control rod 92 consists of a threaded shaft 93 which has a flanged end (not illustrated) which is disposed within a conforming aperture formed in a capture block 94 bolted to the buttress bearing block 66. The capture blocks 94 provide a solid, rotative connection between the shafts 93 and the bearing blocks 66 as the vertical position of the buttress roll is adjusted.

Each threaded shaft 93 also passes through an aperture 96 in the horizontal table 76 and is threadedly secured within a retention element 98 which is affixed to the horizontal table 76 by a pair of bolts 100. Rotation of the control rods 92 is eased by a wheel 102 coaxially affixed to each shaft 93.

Similar to the buttress roll assembly 46, the lead roll assembly 44 is composed of a plurality of individual rollers 50 maintained within individual, extended roller yokes 52 which are mounted for pivoting and horizontal sliding along a channel 104. The lead roll assembly is mounted in a vertically adjustable lead roll bearing block 106 which normally rests upon a pair of integral supports 107 and an elongated support 108 which is attached to the table 76 by a plurality of bolts 110. A close tolerance is maintained between the supports 107 and the support 108 to avoid any horizontal movement of the bearing block 106. If desired, the vertical position of the lead roll bearing block 106 can be altered by adjustment of one or both of a pair of vertical location bolts 112 which are threadedly secured in the table 76 directly beneath opposed vertical end legs 114 and 116 attached to the lead roll bearing block 106.

Similar to the lead and buttress roll assemblies 44 and 46, the horn roll assembly 48 is mounted in an elongated guide 118 attached to a horn member 120. The horn roll, composed of a plurality of individual rollers maintained within individual, extended roller yokes, is securely retained within the elongated guide 118. Individual roller yokes are allowed longitudinal horizontal displacement along the elongated guide and pivoting in the same manner as the individual roller yokes of the lead and buttress rolls.

The corrugated metal sheet entering the forming device 14 comprises a series of parallel undulating ridges and valleys. Each individual roller of each of the roll assemblies 44, 46 and 48 contacts the elongated metal sheet at one point along a series of points disposed generally parallel to the axis of the pipe formed by the apparatus. Since the helical convolutions are curled upward about the horn member 120, the individual rollers of the horn roll assembly 48, being located within the pipe convolutions as they are formed, engage the valleys of the corrugations. The individual rollers of the lead and buttress roll assemblies, being located outside of the pipe convolutions, engage the undersides of the ridges of the corrugations.

In the embodiment illustrated of the spiral pipe forming apparatus 10, adjacent helical convolutions formed in the multiple roll pipe forming device 14 are joined with a double lock seam, although other means of joining marginal edges of curled convolutions, such as welding, could alternatively be employed.

As best illustrated in FIGS. 3 and 6, partial lock seam elements formed by the corrugating device are joined and the completed lock seam formed between an upper lock seaming roll 122 and a lower lock seaming roll 124. The upper roll 122 is composed of a roller 126 contained within an adjustable yoke 128. The yoke 128 extends within an internal annular aperture 130 formed in the horn member 120. A bolt 132, which has an irremovable, rotatable retention washer 134 secured about its shank adjacent the head thereof, is threaded within an internal aperture in the top of the adjustable yoke 128. The retention washer 134 is slightly larger in outer diameter than the internal angular aperture 130, and is bottomed against a land 135 in an enlarged annular aperture 136 formed coaxially with the annular aperture 130. A cap member 138, overlying the retention washer 134, retains the retention washer and bolt 132 securely in place. The cap member 138 is secured to the horn member 120 by a plurality of bolts 140. Therefore, the adjustable yoke 128 may be raised and lowered by simply turning the bolt 132.

The lower lock seaming roll 124 is composed of a roller 142 which complements the shape of the roller 126 and which is mounted within a slidable yoke 144. The yoke 144 has a lower carriage portion 146 having flanges 147 which are positioned about a flanged rail 148 securely attached to the table 76 by a plurality of screws 150. The position of the yoke 144 along the flanged rail 148 is controlled by a threaded rod 152 attached to the lower carriage 146 and which passes through a vertical plate (not illustrated) attached to the edge of the table 76.

The horn member 120 is horizontally adjustable in order to properly position the upper lock seaming roll 122 after repositioning of the relative angle between the corrugating device 12 and multiple roll pipe forming device 14 to enlarge or decrease the diameter of the pipe being manufactured. To accomplish this end, the horn member 120 is sandwiched between a pair of upright support plates 154 and 155. The plate 154 includes an integral flange 156 which is secured to the frame of the pipe forming device 14 by a plurality of bolts 157. Similarly, the plate 155 includes an integral flange 158 which is secured to the frame of the device 14 by a plurality of bolts 159. A top plate 160, attached by a plurality of bolts 161 to the plates 154 and 155, restrains vertical movement of the horn member 120. For horizontal shifting of the horn member, threaded rod 162 extends through a threaded aperture in a vertical plate 163 attached to the plates 154, 155 and 160 into an attachment segment 164 appended to a vertical section 166 formed in the horn member 120.

The end of the threaded rod 162 disposed in the attachment segment 164 rotates freely therewithin. At this point, the threaded rod includes an integral flange 168 disposed within a conforming aperture 170 formed in the attachment segment so that the threaded rod 162 is irremovably mounted within the attachment segment 164. The horn member 120 is locked in place by a locking nut 171 on the rod 162 which can be drawn against the vertical plate 163.

A locking plate 172 is located adjacent the top plate 160. After the horn member 120 has been properly horizontally shifted by adjustment of the threaded rod 162, bolts 173 passing through the plate 172 and threaded within the support plates 154 and 155 are tightened, securely clamping the horn member 120 in place to prevent any vertical or horizontal displacement. Each time the horn member 120 is to be shifted, the bolts 173 are first loosened to relieve the clamping pressure of the locking plate 172.

The corrugating device 12 and the multiple roll pipe forming device 14 are connected by a horizontal stinger 174. One end of the stinger 174 is firmly attached to the carriage 16. The other end of the stinger extends into the pipe forming device 14 beneath the roll assemblies 44, 46 and 48 and is pivotally attached to an upstanding pedestal 176 which is secured to the frame of the pipe forming device.

As the angular disposition between the corrugating device 12 and the multiple roll pipe forming device 14 is changed, not only must the vertical position of the buttress roll assembly 46 be changed in order that adjacent edges of curled convolutions of pipe are in proper abutment, but also each of the roll assemblies 44, 46 and 48 must be shifted horizontally and each of the individual roller yokes pivoted so that the rollers 50 will properly align with the valleys or undersides of ridges of the corrugations in the sheet as it is curled into a pipe. Shifting and automatic pivoting of each of the roller yokes is accomplished by a rigid adjustment frame 178. The adjustment frame 178 slavishly follows pivoting of the corrugating device 12 about the pedestal 176, so that each of the individual rollers of each of the rolls 44, 46 and 48 is always in perfect alignment with the corrugated sheet issuing from the corrugating device 12.

The adjustment frame 178 is pivotally attached to the carriage 16 of the corrugating device 12 by a vertical support 180. A pivot pin 182 is passed through the vertical support 180 and the rigid adjustment frame 178 to allow raising and lowering of the adjustment frame 178.

The adjustment frame 178 comprises a pair of elongated rectangular elements 184 and 186, end elements 188 and 190, and one or more cross-braces 192, if needed. The elements 184 and 186 firmly cage the roll assemblies 44 and 46 between them. As best illustrated in FIG. 6, outboard yokes 44' of the lead roll assembly 44 and 46' of the buttress roll assembly 46 adjoin the elongated element 186. The opposite outboard yoke 44'' of the lead roll assembly 44 includes an integral spacer block extension 194 located between it and the elongated element 184. Similarly, the opposite outboard yoke 46'' of the buttress roll assembly 46 includes an integral spacer block extension 196 disposed between it and the elongated element 184. The spacer blocks are employed to space the elongated element 184 a sufficient distance from each of the lead and buttress rolls so that the elongated element does not interfere with free movement and positioning of the lower seaming roll 124. In the apparatus illustrated, with each of the roller yokes being 2⅜ inches wide, the applicant has found spacer blocks of approximately 2 inches in width sufficient to space the elongated element 184 a proper distance from the lower seaming roll 124.

As can be seen in the drawings, the rigid adjustment frame 178 maintains proper alignment between the lead and buttress rolls and a corrugated sheet issuing from the corrugating device 12 at all times and under all operative conditions. The elongated elements 184 and 186 are always parallel to the marginal edge portions of the corrugated sheet and are properly spaced directly below the sheet so that the parallel individual rollers of the lead and buttress roll align with undersides of corrugations in the sheet. No matter what angular relationship is maintained between the corrugating device 12 and the pipe forming device 14, the rigid adjustment frame 178 always maintains precise alignment of the individual rollers of the lead and buttress rolls.

Figure 4:
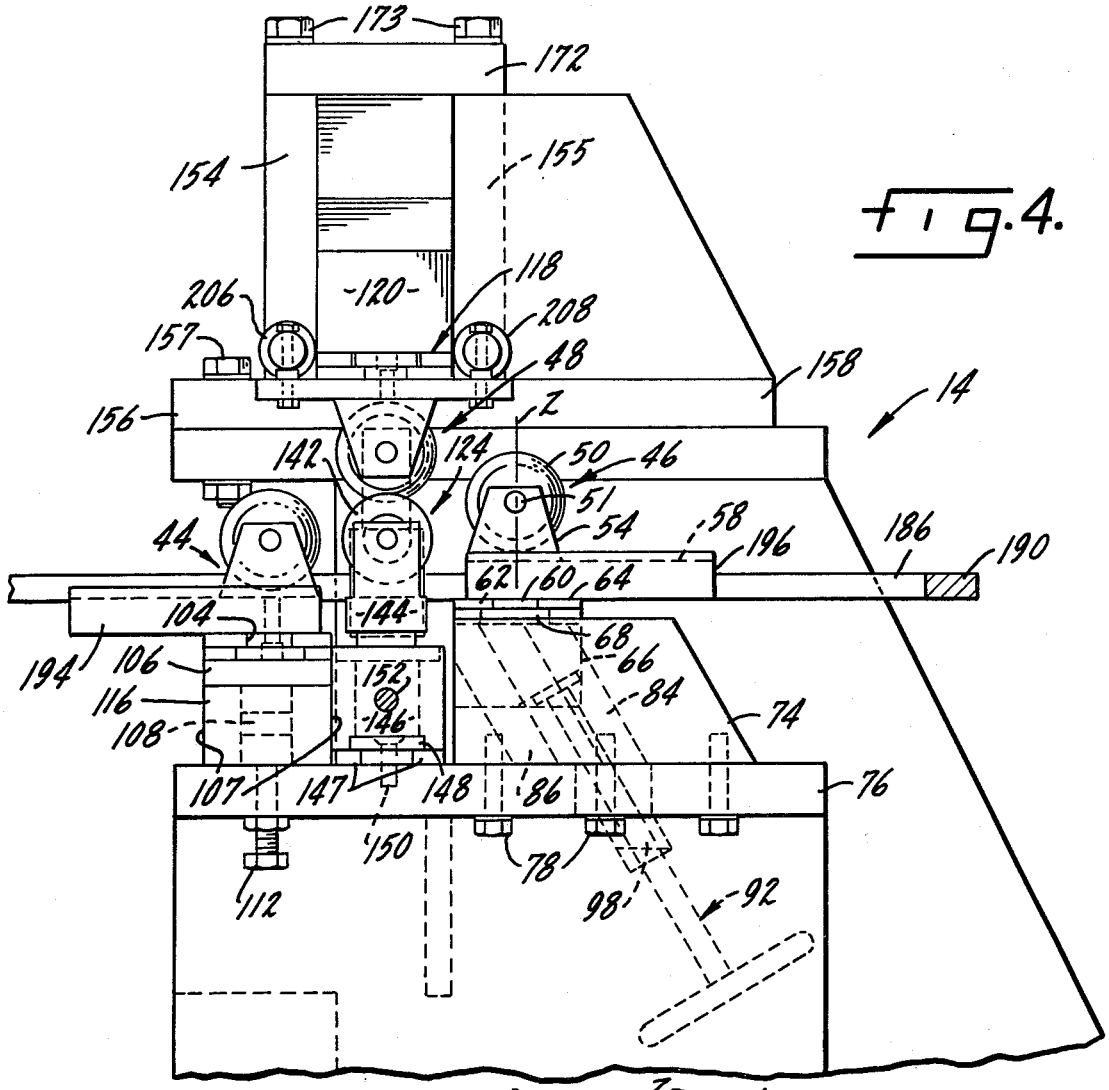
FIG. 4 is a side elevational illustration of the apparatus illustrated in FIG. 3, with the upper seaming roll removed for clarity.

The horn roll assembly 48 is also automatically adjusted by the rigid adjustment frame 178 as the angular relationship between the corrugating device 12 and the pipe forming device 14 is altered. As best illustrated in FIGS. 1, 3 and 4, the left-most outboard roller yoke 48' (as viewed in FIG. 3) of the horn roll assembly 48 has a downwardly depending adjustment arm 198 firmly attached thereto. The arm 198 is secured to the top of a box member 200 disposed about the elongated element 186. A close tolerance is maintained between vertical portions 202 and 204 of the box member 200 and the elongated element 186 to assure no lateral play between the two. A pair of extensible contraction mechanisms 206 and 208 (such as, for example, an internal spring or piston, not shown) straddle the horn member 120 and are attached to opposite outboard yokes 48' and 48'' of the horn roll assembly 48. The contraction mechanisms 206 and 208 constantly draw the individual roller yokes of the horn roll assembly together to prevent inadvertent spreading and assure that each of the rollers of the horn roll assembly properly aligns with valleys of corrugations in an elongated metal sheet as it is spiralled into helical convolutions.

As the rigid adjustment frame 178 is horizontally shifted as the corrugating device 12 is pivoted relative to the pipe forming device 14, the box member 200 in combination with the downwardly depending adjustment arm 198 maintain proper alignment of the outboard yoke 48' of the horn roll assembly 48. At the same time, the extensible contraction mechanisms 206 and 208 cause the remaining roller yokes of the horn roll assembly 48 to follow the yoke 48'. Therefore, not only are the lead roll and buttress roll assemblies always automatically properly aligned, but also the horn roll assembly is properly aligned each time the angular position between the corrugating device 12 and the pipe forming device 14 is changed. This occurs regardless of direction of change of the angular position, and regardless of the size of the change.

Various changes may be made to the invention without departing from the spirit thereof or the scope of the following claims.

I claim:

1. In an apparatus for continuously forming corrugated metal pipe from an elongated sheet of metal, the apparatus having a corrugating device to impress longitudinal corrugations in the sheet, a multiple roll pipe forming device for accepting the corrugated sheet and spiralling the sheet into successive, adjacent helical convolutions having a central axis formed at an oblique angle to the axis of the longitudinal corrugations in the sheet, and a seaming device to join adjacent helical convolutions, the improvement comprising:

a. at least one roll of said multiple roll forming device comprising a plurality of adjacent, unconnected parallel roller elements, the periphery of each of said roller elements engaging one surface of said sheet at one point along a series of points generally parallel to the central axis of the helical convolutions, and b. means unattached to said roller elements to automatically shift each of said plurality of roller elements along a line parallel to said series of points and change the spacing between adjacent points of each of said series of points as the angle between the central axis of the convolutions and the axis of the longitudinal corrugations in the sheet is varied, said means to automatically shift including a pair of members fixed relative to one another, said members adjoining opposite ends of said one roll and mounted for lateral movement relative to said one roll, said roller elements being continually confined between said members.

2. The apparatus according to claim 1 in which the multiple roll forming device comprises three horizontally disposed forming rolls, each of said forming rolls comprising a said plurality of adjacent, unconnected roller elements.

3. The apparatus according to claim 2 in which each roller element is mounted in an individual roller yoke member, with adjacent yoke members of each of said three forming rolls abutting one another along sliding interfaces located on lines generally parallel to planes encompassing the peripheries of each of said roller elements.

4. The apparatus according to claim 1 including a horizontally adjustable horn member for mounting a horn roll of said multiple roll forming device, said horn roll forming a pivot axis at which the corrugated sheet is spiralled into helical convolutions.

5. The apparatus according to claim 4 in which the seaming device comprises a pair of upper and lower lockseaming rolls, the upper lockseaming roll being mounted in said horn member.

6. The apparatus according to claim 5 including adjustment means to raise and lower the upper lockseaming roll.

7. The apparatus according to claim 1 in which said pair of members is retained horizontally immobile with respect to the corrugating device.

8. The apparatus according to claim 7 in which said pair of members is attached to said corrugating device and comprises a pair of elongated, rigid position control members.

9. In an apparatus for continuously forming corrugated metal pipe of multiple sizes from an elongated sheet of metal, the apparatus having a corrugating device which forms longitudinal corrugations in the sheet, a three roll forming device having first, second and third rolls for accepting the corrugated sheet and spiralling the sheet into successive, adjacent helical convolutions having a central axis formed at an oblique angle to the axis of the longitudinal corrugations in the sheet, and a seaming device to join adjacent helical convolutions, the improvement comprising:

a. each of the three rolls of the forming device comprising a plurality of adjacent, unconnected parallel roller elements, the peripheries of each of said plurality of roller elements engaging one surface of said sheet along a series of points generally parallel to the central axis of the helical convolutions, b. a horizontally disposed horn member for mounting the second roll of said three roll forming device, said second roll forming a pivot axis at which the corrugated sheet is spiralled into helical convolutions, with said second roll being located within the helical convolutions and the other two rolls of said three roll forming device being located without the helical convolutions, and c. frame means mounted on the corrugating device and extending into the forming device to automatically shift each of said three rolls along lines parallel to the axis of the helical convolutions and change the spacing between adjacent points of each of said series of points as the angle between the central axis of the convolutions and the axis of the longitudinal corrugations in the sheet is varied, said frame means being unattached to said roller elements and adjoining at least one end of each of said other two rolls along a slideable interface, with said frame means being mounted for lateral movement relative to said other two rolls.

10. The apparatus according to claim 9 in which each of said roller elements is mounted for rotation within a separate yoke member, with adjacent yoke members of each of said three rolls abutting one another along a slideable interface disposed generally parallel to planes encompassing the peripheries of each of said roller elements.

11. The apparatus according to claim 10 including respective elongated channels in the forming device for mounting the yokes of each of said three pluralities of roller elements, the longitudinal axis of each of said channels being generally parallel to the axis of said convolutions.

12. The apparatus according to claim 10 in which said frame means includes a pair of elongated, rigid position control members fixed relative to one another and located adjacent, but unattached to, opposite outboard yokes of each of said other two rolls, said position control members caging and firmly retaining said yoke members of said other two rolls between them.

13. The apparatus according to claim 10 including a resilient guide means attached to said second roll to maintain constant abutting contact between the individual yokes of said second roll.

14. The apparatus according to claim 13 including adjustment means to automatically shift said second roll, said adjustment means rigidly interconnecting an outboard yoke of said second roll and said frame means, and being shiftably connected to said frame means.

15. The apparatus according to claim 13 in which said resilient guide means comprises a pair of elongated, extensible contraction mechanisms located on opposite sides of said second roll, each of said mechanisms being connected to each outboard yoke of the plurality of yokes of said second roll.

16. The apparatus according to claim 9 in which said horn member is horizontally adjustable.

17. The apparatus according to claim 9 in which the first roll is farthest upstream and is vertically adjustable, and the third roll is farthest downstream and is adjustable on an angle to the vertical to vary the diameter of helical convolutions produced by said apparatus.

* * * * *